US005459969A

United States Patent [19]

Stibolt et al.

[11] Patent Number: 5,459,969

[45] Date of Patent: Oct. 24, 1995

[54] DRYWALL CORNER FINISHING DEVICE

[75] Inventors: Paul E. Stibolt, 9801 E. Iliff Avenue, Denver, 80231; Russell E. Judy, 14290 Foothills Circle, Golden, 80401, both of Colo.

[73] Assignee: Kimberly-Clark Corporation, Neenah, Wis.

[21] Appl. No.: 234,423

[22] Filed: Apr. 28, 1994

[51] Int. Cl.[6] ..... E04F 19/04; E04F 13/06

[52] U.S. Cl. ..... 52/254; 52/716.8; 52/717.05

[58] Field of Search ..... 52/254–257, 90.1, 52/287.1, 288.1, 716.8, 717.05

[56] References Cited

U.S. PATENT DOCUMENTS

| | | |
|---|---|---|
| 3,444,657 | 5/1969 | Swanson . |
| 3,989,397 | 11/1976 | Baker . |
| 4,012,878 | 3/1977 | Ellingson . |
| 4,313,991 | 2/1982 | Lamb . |
| 4,315,390 | 2/1982 | Schaafsma . |
| 4,553,363 | 11/1985 | Weinar . |
| 4,624,087 | 11/1986 | Schneller . |
| 4,719,732 | 1/1988 | Bernard . |
| 4,863,774 | 9/1989 | Tucker . |
| 5,037,686 | 8/1991 | Conboy . |
| 5,045,374 | 9/1991 | Tucker . |
| 5,086,598 | 2/1992 | Weldy . |
| 5,131,198 | 7/1992 | Ritchie et al. . |

*Primary Examiner*—Carl D. Friedman
*Assistant Examiner*—Yvonne Horton-Richardson
*Attorney, Agent, or Firm*—Dorr, Carson, Sloan and Birney

[57] ABSTRACT

A finishing device used to form a corner between two panels of drywall has a flexible joint extending along a predetermined axis. Two wings are connected to and extend outwardly in a diverging relation from the flexible joint to form a corner having an adjustable angle. Each wing has a front surface, a rear surface, and an edge distal from the flexible joint. This edge abuts one of said drywall panels and has a thickness approximately equal to the thickness of the drywall panel. A layer of primer or adhesive laminate is applied to the front surface of the wings so that paint can bond to the front surface. The finishing device is capable of forming both inside and outside corners. To form inside corners, the finishing device bends along the flexible joint. To form outside corners, strips parallel to the flexible joint are removed from the rear surface of the wings and the finishing device is folded along the openings thus created.

23 Claims, 8 Drawing Sheets

Fig. 5
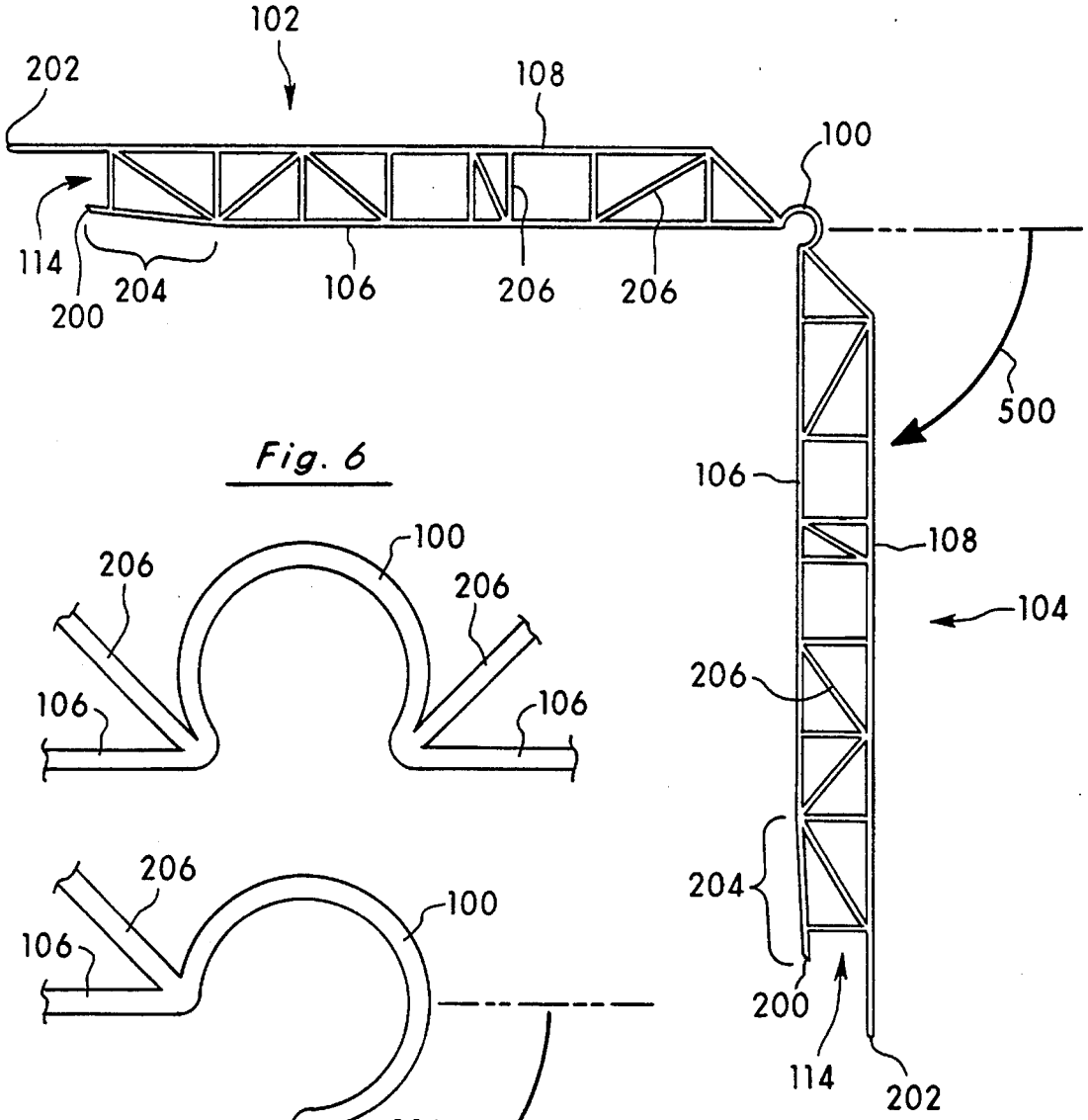
Fig. 6
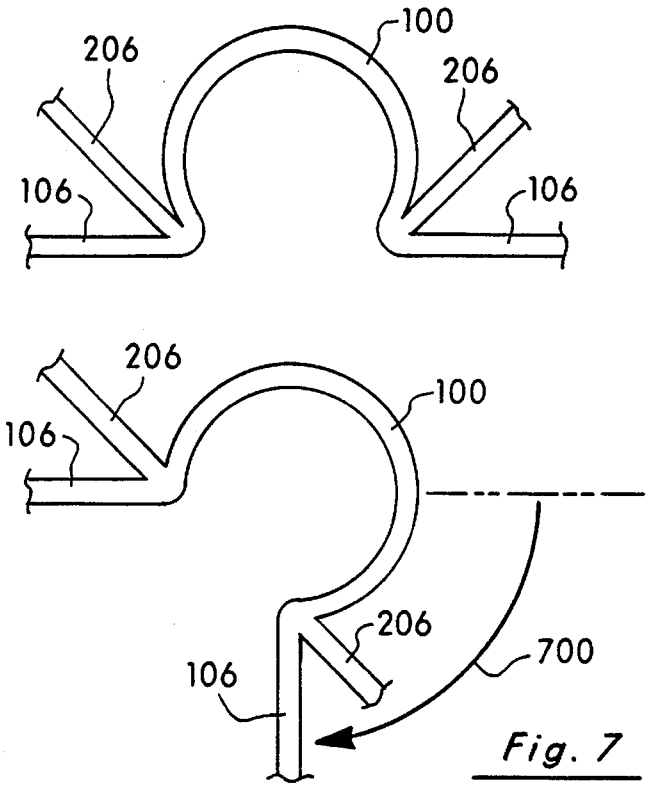
Fig. 7

Fig. 12(a)
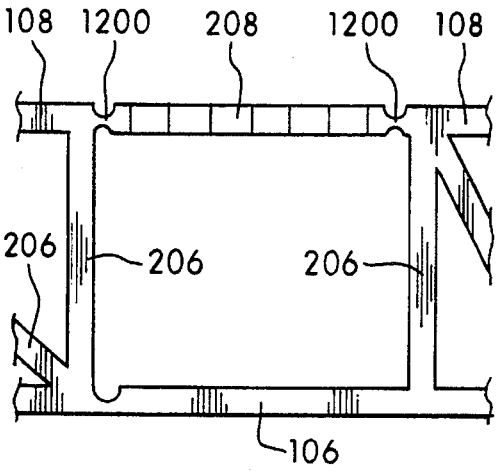
Fig. 12(b)
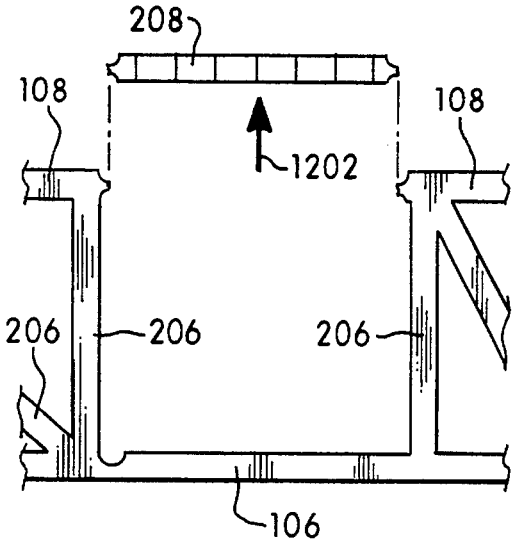
Fig. 12(c)
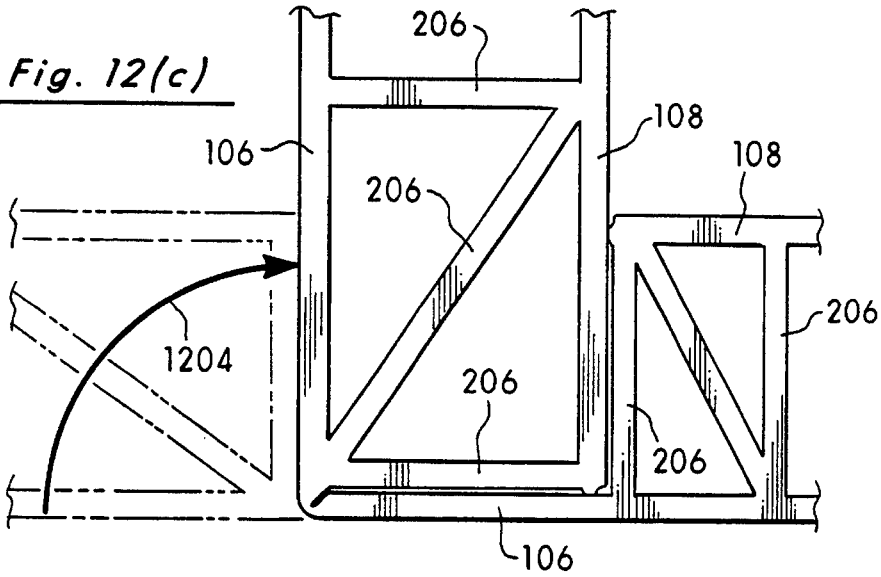
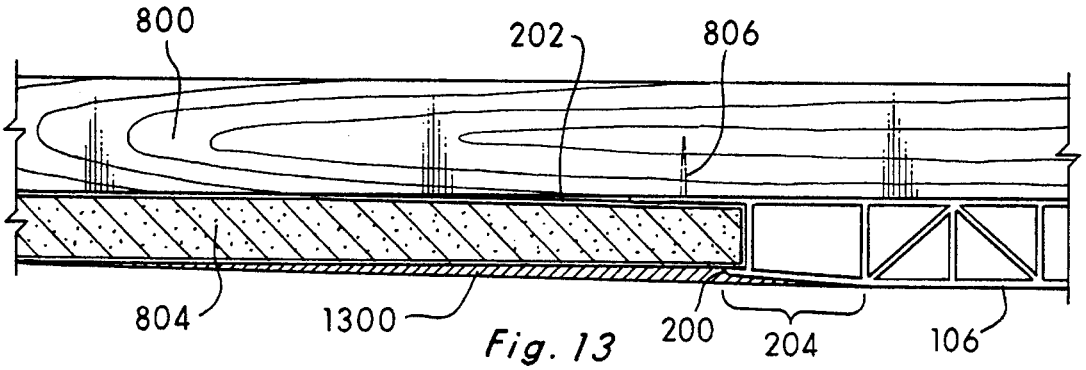
Fig. 13

DRYWALL CORNER FINISHING DEVICE

BACKGROUND OF THE INVENTION

1. Field of the Invention

This invention relates to finishing interior walls. In particular, this invention relates to finishing the edges at intersections where two walls meet.

2. Statement of the Problem

Drywall panels are widely used in the construction industry for forming the interior walls and ceilings of rooms. Drywall panels are made of a gypsum or reinforced gypsum core covered with paper. Drywall panels have the advantages of being easy to cut to desired sizes and to attach to assorted types of framing. However, it is very difficult to cut drywall panels so that the edges are perfectly straight and smooth and can meet to form a perfectly straight corner, which is aesthetically to be desired. In addition, when the drywall panels are cut to the desired sizes, the edges of the panels are left exposed. This exposed gypsum core is soft and tends to crumble unless the severed edges are somehow protected. This is especially important at outside wall corners.

When walls and ceilings are built of framing materials such as wood, the inside and outside corners thereby formed are seldom perfectly straight. Small variations in the sizes of the wood framing members, warping of the wood, and inconsistent building practices lead to imperfectly straight corners where walls and ceilings meet, and where walls end at doorways and passageways. When drywall panels are then attached to the crooked framing materials, their intersections will also be crooked.

An assortment of devices have been used to provide a smooth and durable finish for the intersections where two pieces of drywall abut to form an inside or outside corner. Among the conventional devices used are drywall tape and metal corner beads. Conventional drywall tape is provided in narrow, elongated ribbons or strips of porous paper wound into rolls. The paper is sometimes perforated to increase moisture penetration and to prevent air bubbles from being entrapped behind the tape. The drywall tape is first applied to joints and edges of abutting drywall panels and is then covered with wet plaster, sometimes called "mud." The plaster is feathered and smoothed along the edges of the tape to conceal the demarcations between the tape edges and the drywall panels to which the tape is applied. When the wet plaster has dried, the tape and drywall can be painted or otherwise covered with a suitable wall covering.

A great deal of skill is needed to apply the plaster to both sides of an inside corner such that a perfectly straight intersection is achieved. Also, to correct the crookedness resulting from the warped framing members and inconsistent building practices described above, often several coats of plaster must be applied, with an entire day of drying time needed between each coat. Even then, a perfectly straight corner seldom results. It is also likely that, unless in the most highly skilled hands, the plaster trowel will mar the first side of the plaster while the second side is being applied. Once the plaster has been applied and dried, it must be sanded to an appropriate finish to provide a surface suitable for the application of paint or wallpaper.

Coffered and vaulted ceilings have recently become very popular among homebuilders and buyers. Often the peak of such ceilings will form an acute angle. It is difficult to fit a conventional plaster trowel into such angles.

Because drywall tape is formed of paper, it is quite flexible and will conform to various surface configurations of the edges of intersecting panels of drywall. When conventional drywall tape is used at the outside corners of walls, the flexibility of the tape often results in a corner demarcation that is irregular, since the tape conforms to irregularities in the exposed, severed edges of the drywall panels. The tape is also fragile and does not stand up well to the constant physical abuse suffered by outside corners. As a consequence, conventional drywall tape cannot be used at exposed outside corners.

To finish outside corners in building construction, therefore, metal corner beads are often used. Conventional metal beads are configured in an L-shaped or angle-shaped cross section and are typically fabricated from elongated perforated strips of metal, such as galvanized steel, permanently deformed with a lengthwise 90-degree bend to form elongated angles. The metal beading is typically positioned at the intersections of adjacent drywall panels that meet at right angles to form an outside corner within a room. The sections of metal beading are nailed in place through the drywall panels to wooden supporting structural members located behind the drywall panels. Wet plaster is then smoothed into place to cover the metal flanges or leg members of the metal beading, and the edges of the plaster are smoothed and feathered to attempt to conceal the metal edges.

While the rigidity of the metal beading does allow an outside corner of an inside building wall to be finished with a sharp, straight edge, which is aesthetically pleasing, the use of metal beading involves some significant problems. Over time, the metal corner bead will rust, thereby producing rust stains that are clearly visible on the surfaces of the walls at the corner. It is not always possible to completely cover the edges of the metal flanges or the nail heads used to attach the metal corner bead to the drywall panel, detracting from the desired smooth appearance of the wall. Cracks often develop in the overlying plaster at the outer edges of the flanges. To prevent this from happening, often two or three coats of plaster are applied, with prior coats allowed to dry and harden, which may take as long as 24 hours, before a subsequent coat is applied. When the corners are crooked or jagged due to problems with the underlying framing, metal beads do not cover enough surface area or have enough flexibility to correct the inequalities that exist. Another problem is inherent in the fact that the malleable metal from which the metal beads are made has a very poor memory and is subject to being dented or wrinkled, after which it is difficult to straighten it to produce a smooth finish. Because of the rough handling to which most of the material at a work site is subjected, it is not uncommon for the strips to be wrinkled, dented, and perhaps twisted, thus rendering them either unusable, or usable only to produce an inferior end result. In addition, the metal strips are used in large quantities in construction and can add up to considerable cost.

A number of corner finishing devices have been developed to address the above-described problems. Among these devices are the following:

| Inventor | Patent No. | Date |
|---|---|---|
| Swanson | 3,444,657 | May 20, 1969 |
| Baker | 3,989,397 | Nov. 2, 1976 |
| Ellingson | 4,012,878 | Mar. 22, 1977 |
| Lamb | 4,313,991 | Feb. 2, 1982 |

-continued

| Inventor | Patent No. | Date |
|---|---|---|
| Schaafsma | 4,315,390 | Feb. 16, 1982 |
| Weinar | 4,553,363 | Nov. 19, 1985 |
| Schneller | 4,624,087 | Nov. 25, 1986 |
| Bernard | 4,719,732 | Jan. 19, 1988 |
| Tucker | 4,863,774 | Sep. 5, 1989 |
| Conboy | 5,037,686 | Aug. 6, 1991 |
| Tucker | 5,045,374 | Sep. 3, 1991 |
| Weldy | 5,086,598 | Feb. 11, 1992 |
| Ritchie et al. | 5,131,198 | Jul. 21, 1992 |

Swanson and Lamb describe plastic joint strips that can be reversibly bent to be adhesively secured to both inside and outside corners.

Baker shows an outside corner connector for waterbed pedestals in which the panels forming the pedestal are inserted into the connector.

Ellingson provides a double-layer wall member guard structure for outside corners made of a resilient material.

Schaafsma describes two types of wallboard corners, one for inside corners that is held in place by putty and another for outside corners that is held in place by the drywall panels themselves. The former is disadvantaged by the fact that it is held on only by putty; if the putty does not adhere well to the drywall, the corner will become loose. The outside corner must be placed under the drywall panels, involving considerable bending or, if placed on the corner before the panels, a certain amount of extra effort to hold the corner in place while the panels are being nailed over it. Both corners use tape to provide a smooth top finish that can be blended in with the drywall finish by applying plaster and sanding.

Weinar provides a plastic or metal T-shaped corner construction in which the post of the T sits between two abutting pieces of drywall and the cross bar lies atop the drywall panels. Part of the paper covering from one panel is wrapped around the cross bar to provide a finished appearance, leaving a ridge down one side of the corner. This corner construction can only be used on outside corners.

Schneller describes yet another type of metal outside corner bead in which an additional flange extends over the edge of the drywall board forming the outside corner. Ridges are left on both sides of the corner, and this corner bead can only be used on outside corners.

Bernard presents a plastic L-shaped outside corner cover that uses heat-shrinkable plastic tape along the arms both as a method of attachment and as a method of providing a smooth junction between the cover and the drywall. This cover can be used for outside corners having a variety of angles.

Tucker provides a paper drywall ribbon having a centrally located plastic bead extending longitudinally along the ribbon. Plaster is used to attach the ribbon to the drywall. This plastic bead is designed to be used with outside corners only.

Conboy describes a plastic drywall tape that can be used on both inside and outside corners. Again, this plastic tape is held on the corner with plaster, and plaster is used to provide a finished appearance.

Tucker describes a stiff plastic strip with a curved center section and two flanges that is attached to outside or inside corners with adhesive. The flanges are then covered with paper tape strips and plaster.

Weldy provides a wall edging system for both inside and outside corners that comprises a plastic strip having an arcuate center portion to which are attached two flanges at right angles. The strip is attached to the drywall with nails. Plaster is then smoothed over the strip to finish the edges. The side of the strip facing out toward the room can be finished with primer.

Ritchie et al. describe a corner bead for outside corners that has a metal core and that is completely covered by paper. This bead has a rounded nose and side flanges. The paper covering is further coated with a reinforcing emulsion. The corner bead is nailed to the drywall, and plaster is used to hide the edges.

A need exists for a drywall corner finishing device that can be used on both outside and inside corners having various angles and that provides a primed surface for either orientation. A further need exists for a drywall corner finishing device that can be used to cover juxtaposed outside corners, such as are found at the edges of interior doorways or other openings of various dimensions, for example, passthroughs from one room to another. Because of the crooked corners that result from warped building materials and inconsistent building practices, a need exists for a corner finishing device that will provide a perfectly straight corner without the use of multiple coats of plaster. A finishing device is also needed that will simplify installation of drywall in acutely angled inside corners and minimize the need to use plaster. None of the above-described drywall corners fulfills these needs.

3. Solution to the Problem

The drywall corner finishing device described herein can be used for both inside and outside corners having various angles. Builders will not have to order two or more versions to cover different types of corners. The drywall corner finishing device described herein can also be used to cover two adjacent outside corners without requiring the use of a narrow strip of drywall panel between the corners and two finishing devices, one for each outside corner. A layer of primer or laminate covers the side of the drywall corner finishing device of the present invention that faces into the room. Because of this primer or laminate layer, plaster need only be used on the outside edges of the corner finishing device where it abuts the drywall. The drywall corner finishing device described herein has a width generally equal to that of the drywall panels, so that little plaster is needed to fill in the area where the drywall panels meet the finishing device. The drywall corner finishing device of the present invention is capable of hiding crooked, uneven corners no matter how irregular the deviations may be. The present drywall corner finishing device is nailed directly to the framing members of the wall, thereby providing stability.

SUMMARY OF THE INVENTION

A finishing device used to form a corner between two panels of drywall has a flexible joint extending along a predetermined axis. Two wings are connected to and extend outwardly in a diverging relation from the flexible joint to form a corner having an adjustable angle. Each wing has a front surface, a rear surface, and an edge distal from the flexible joint. This edge abuts one of the drywall panels and has a thickness approximately equal to the thickness of the drywall panel. A layer of primer or adhesive laminate is applied to the front surface of the wings so that paint or wallpaper or other wallcoverings can bond to the front surface. The finishing device is capable of forming both inside and outside corners. To form inside corners, the finishing device bends along the flexible joint. To form outside corners, strips parallel to the flexible joint are removed from the rear surface of the wings and the finishing device is folded along the openings thus created.

BRIEF DESCRIPTION OF THE DRAWINGS

The present invention can be more readily understood in conjunction with the accompanying drawings, in which:

FIG. 5 shows a cross-sectional view of the drywall corner finishing device in accordance with the present invention bent to fit inside corners;

FIG. 6 is a detailed cross-sectional view of the center joint of the drywall corner finishing device as shown in FIG. 2;

FIG. 7 shows a detailed cross-sectional view of the center joint of the drywall corner finishing device as shown in FIG. 5;

FIG. 12(*a*) shows a detailed cross-sectional view of the removable strip of the drywall corner finishing device in accordance with the present invention;

FIG. 12(*b*) is a detailed cross-sectional view showing the removal of the removable strip of FIG. 12(*a*);

FIG. 12(*c*) is a detailed cross-sectional view showing how the drywall corner finishing device is folded after the removal of the removable strip of FIG. 12 (*a*); and FIG. 13 is a cross-sectional view of the drywall corner finishing device in accordance with the present invention showing the application of plaster to the joint.

DETAILED DESCRIPTION

Figure 1:
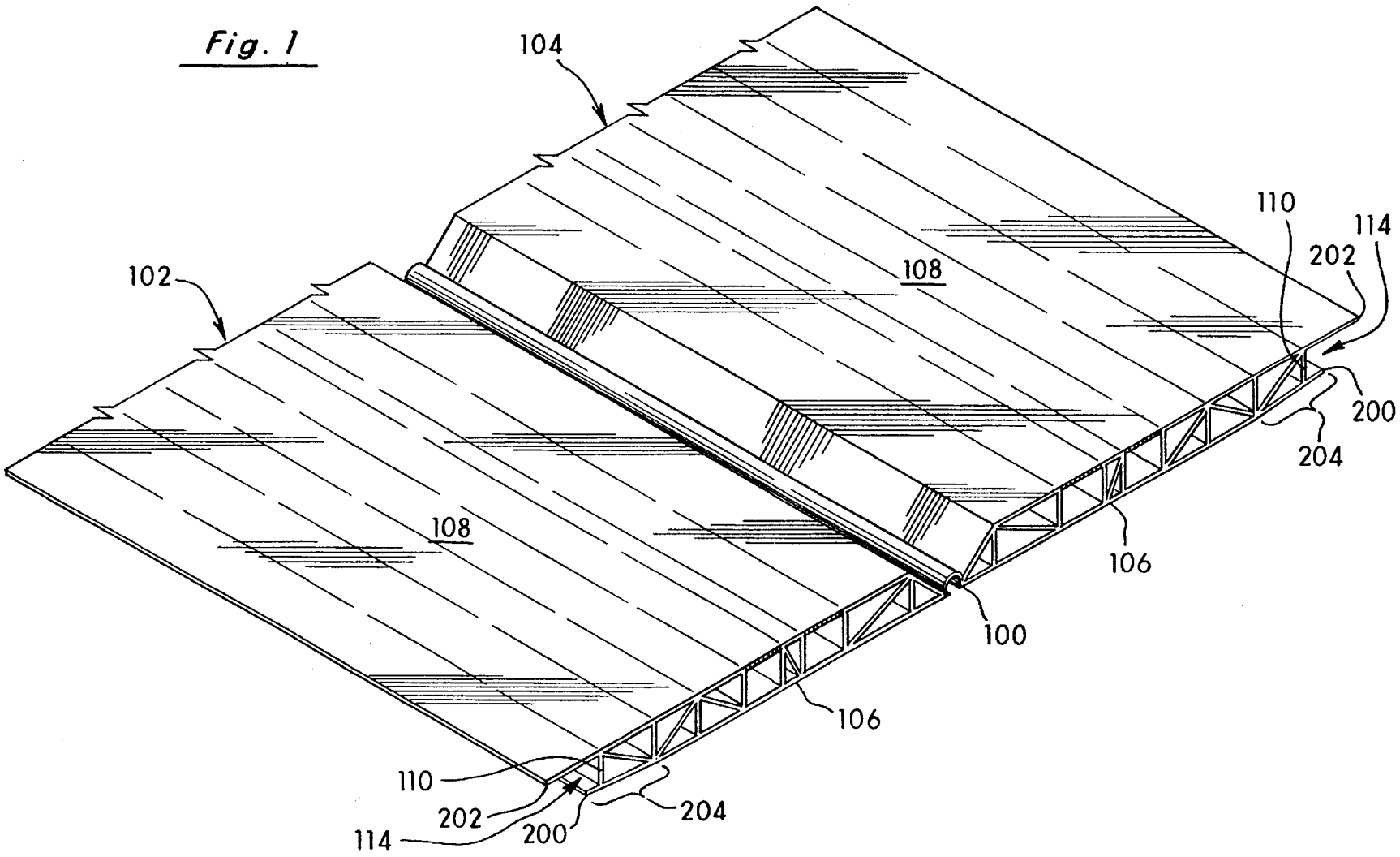
FIG. 1 is a partial perspective view of the drywall corner finishing device in accordance with the present invention.
Figure 3:
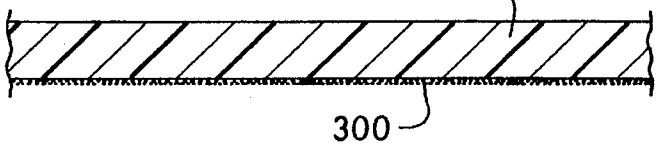
FIG. 3 is a detailed cross-sectional view taken from the outlined section of FIG. 2 showing the front surface of the drywall corner finishing device in accordance with the present invention covered with a layer of primer.
Figure 4:
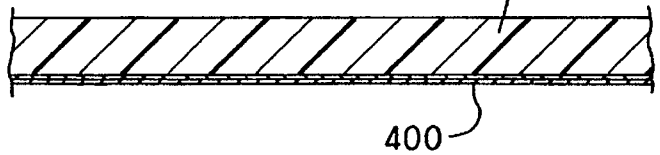
FIG. 4 shows a detailed cross-sectional view taken from the outlined section of FIG. 2 showing the front surface of a second embodiment of the drywall corner finishing device in accordance with the present invention covered with a layer of adhesive laminate.

Turning to FIG. 1, the left 102 and right 104 wings of the drywall corner finishing strip are attached to a flexible center joint 100 and extend outwardly therefrom to a distal edge 110. The wings 102, 104 have a front surface 106 and a rear surface 108. The front surface 106 and rear surface 108 extend outwardly beyond the distal edge 110 of the wings 102,104 to cover the distal edge 110. When the drywall corner finishing device covers either an inside corner or an outside corner, the rear surface 108 of the device is juxtaposed to the framing of an interior wall while the front surface 106 faces out into the room, contiguous with the surface of the drywall panels forming the wall. The front surface 106 may be covered with a layer of primer 300 as shown in FIG. 3 so that any paint or wallcovering that is eventually used to decorate the wall will adhere easily. Alternatively, the front surface 106 may have an adhesive laminate 400 attached to it as shown in FIG. 4.

Figure 2:
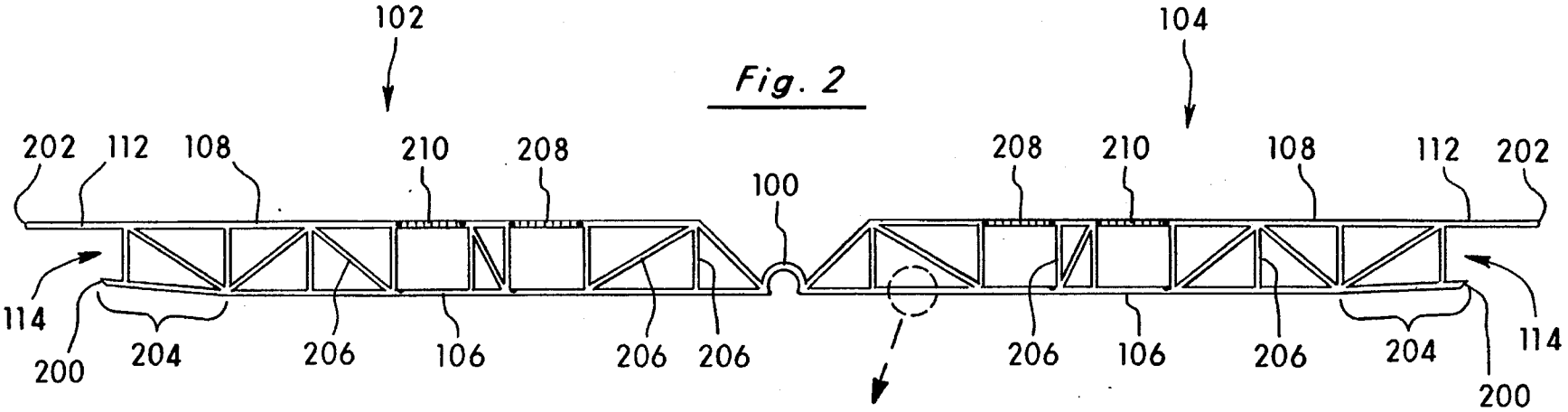
FIG. 2 shows a cross-sectional view of the drywall corner finishing device in accordance with the present invention.

The structure of the drywall corner finishing device is more clearly seen in FIG. 2. The flexible center joint 100 is preferably arcuate, but it is to be expressly understood that any joint shape, such as V-shaped, U-shaped, C-shaped, etc., can be used that allows the device to bend through a variety of angles at the center joint 100. The center joint 100 extends along an axis that extends linearly to form a corner or edge.

A number of struts 206 separate the rear surface 108 of each wing 102, 104 from the front surface 106 of each wing 102, 104. In the preferred embodiment shown in FIGS. 1 and 2, the pattern of struts 206 provides stability to the structure of the corner device and also allows the device to be folded around outside corners, as discussed in more detail below. It will be obvious to one skilled in the art that the pattern of struts 206 shown in FIGS. 1 and 2 is not the only pattern that will provide these features of stability and folding and that other patterns would be suitable and are to be included in the present invention.

The edge 202 of the rear surface 108 extends beyond the edge 200 of the front surface 106. The distal portion 204 of the front surface 106 tapers slightly toward the rear surface 108 so that, as discussed in more detail below, the edge of a drywall panel can be placed in the space 114 between the front surface 106 and the rear surface 108 such that the edge 202 of the rear surface 108 and the edge 200 of the front surface 200 are in close apposition to the drywall panel. The rear surface 108 contains a number of removable strips 208, 210 that are removed when it is desired to fold the drywall corner finishing device around outside corners, as discussed in more detail below.

Figure 8:
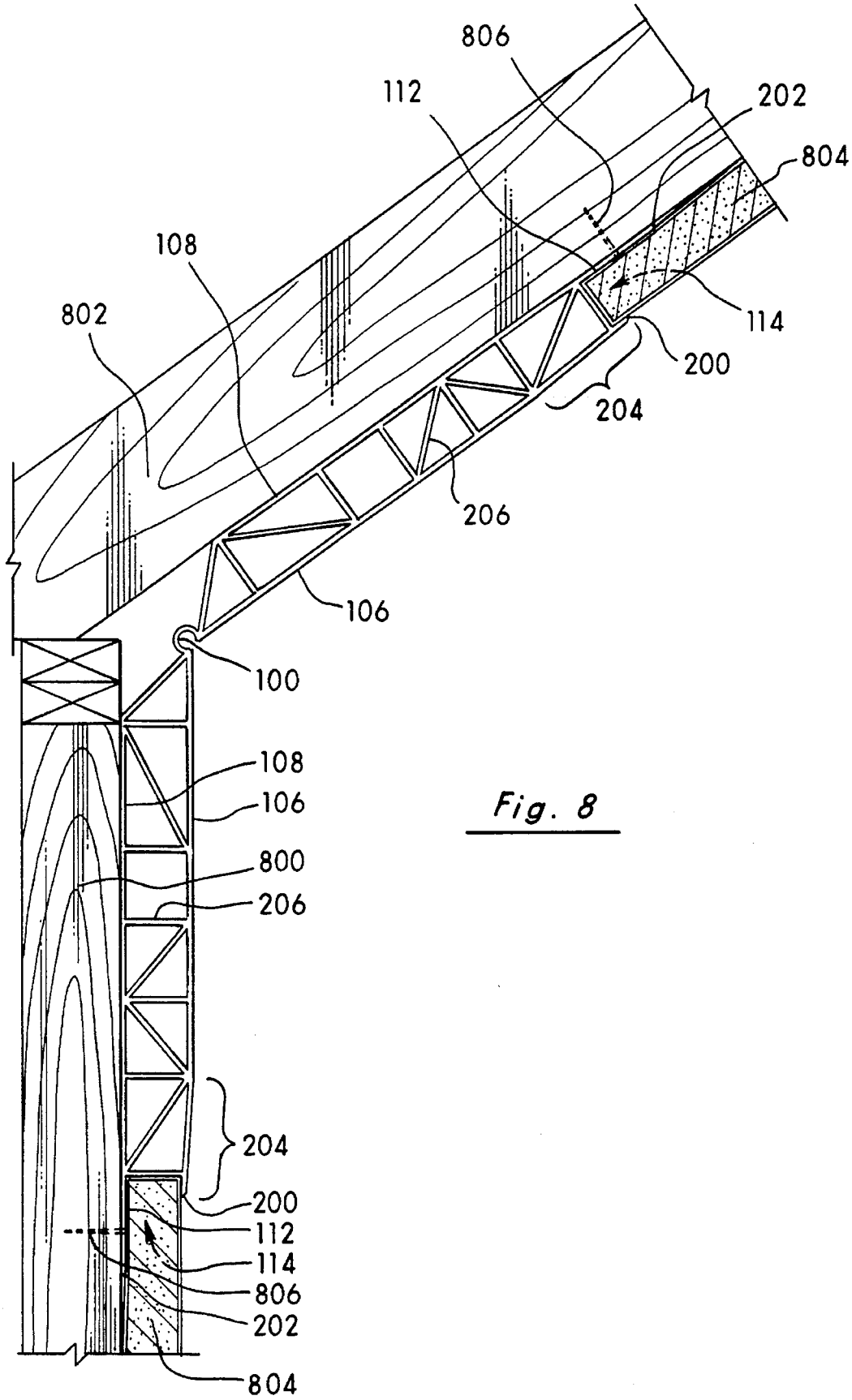
FIG. 8 shows a cross-sectional view of the drywall corner finishing device in accordance with the present invention applied to an inside corner between a wall and a ceiling.
Figure 9:
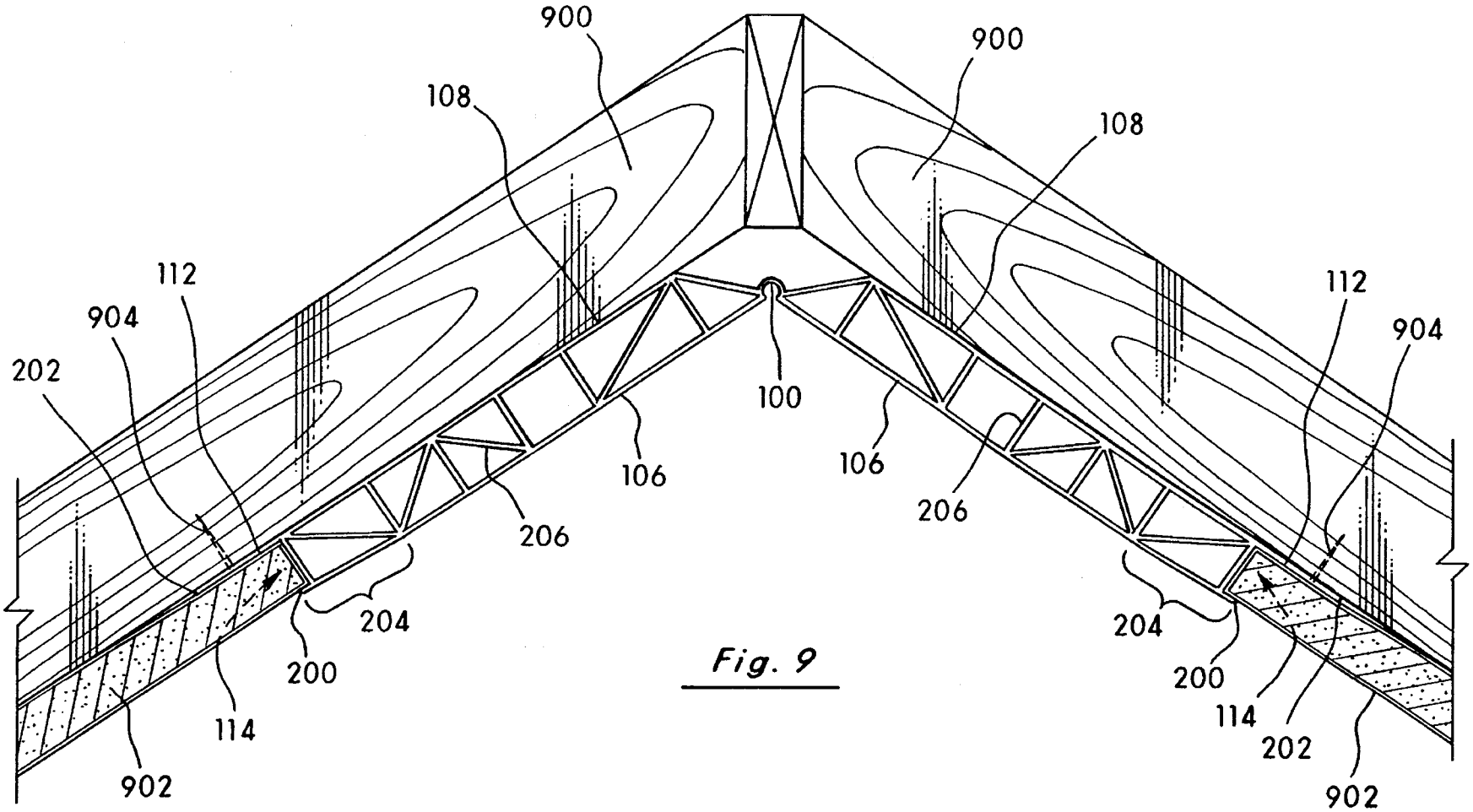
FIG. 9 is a cross-sectional view of the drywall corner finishing device in accordance with the present invention applied to an inside corner formed at the top of a ceiling.

FIG. 8 illustrates the inside corner formed when a vertical wall meets a coffered or cathedral ceiling. FIG. 9 shows the inside corner formed at the vault of such a ceiling. Depending on the design of the building, these corners may have angles ranging from less than 90 degrees to 180 degrees. When the drywall corner finishing device is used to finish an inside corner, the rear surface 108 is first placed directly against the framing. The center joint 100 flexes from 180 degrees, shown in FIG. 6, to the appropriate angle needed to fit the angle made by the corner, as shown by arrow 500 in FIG. 5 and arrow 700 in FIG. 7.

As an example, in FIG. 8, the finishing device is attached to the wall framing 800 and ceiling rafter 802 by use of nails 806. The finishing device is made of plastic soft enough to permit the nails 806 to be driven through the flange 112 of the rear surface 108 without the need for pre-formed holes. It is to be expressly understood that other methods such as the use of screws, bolts, adhesive, etc., will be equally efficacious in attaching the finishing device to the supporting members of the wall or ceiling. The attachment location of the device and the positions of the nails 806 can be varied to enable the device to correct inequalities that may exist within the framing and from one framing member 800 to the next. If necessary, shims may be placed behind the device before it is attached by nails 806. After the device has been securely attached to the framing 800 and rafter 802, the edges of the drywall panels 804 are inserted into the spaces 114 between the front surface 106 and rear surface 108, such that the edges of the drywall panels 804 abut the distal edges 110 of the wings 102, 104. It can be seen in FIG. 8 that the spaces 114 between front surface 106 and rear surface 108 are just large enough to accommodate the drywall panels 804 and that the front surface 106 and rear surface 108 are closely juxtaposed to the drywall panels 804. The drywall panels 804 thus hide the nails 806. The drywall panels 804 are attached to the framing 800 and rafter 802 in the usual fashion.

As FIG. 13 shows, plaster 1300 is then applied to the tapered distal portion 204 of the front surface 106 and the tapered edge of the drywall panel 804 to hide the edge 200 and provide a smooth, level surface. Because plaster 1300 is applied only to the tapered portion 204 of the finishing device, difficulties inherent in plastering within corners are avoided. Such difficulties include, among others, the difficulty in maneuvering a plaster trowel within a corner, the skill needed to produce a perfectly straight edge where the two sides of the corner meet, and the need for several layers of plaster 1300 to completely hide the joint between the finishing device and the drywall or to correct the inequalities resulting from mis-sized, mis-placed, or warped framing members, with each layer requiring considerable time to dry. Once plaster 1300 has been applied, the surface of the wall can be finished by painting, wallpapering, or any other method desired. The primer 300 bonded to the front surface 106 enables paint or other wallcoverings to adhere to the front surface 106 of the finishing device. In another embodiment, a laminate 400 can be adhesively affixed to the front surface 106 to provide a surface for subsequent painting.

A second example of the use of the finishing device for inside corners is shown in FIG. 9. Here, the finishing device provides an inside corner essentially as described above, except here the corner is that formed by the vault of a coffered ceiling. The device is attached to the rafters 900 by driving nails 904 through the flanges 112. The attachment location of the device and the positions of the nails 904 can be varied to enable the device to correct inequalities that may exist within the rafters 900 and from one rafter 900 to the next. If necessary, shims may be placed behind the device before it is attached by nails 904. The edges of the drywall panels 902 are then inserted into the spaces 114 between the front surface 106 and rear surface 108. As above, these spaces 114 are just large enough to accommodate the edges of the drywall panels 902, so that the front surface 106 and rear surface 108 are in close apposition to the drywall panels 902. The drywall panels 902 thus hide the nails 904. The drywall panels 902 are attached to the rafters 900 in the usual fashion. Plaster 1300 is then applied to the tapered distal portion 204 of the front surface 106 and the edge of drywall panels 902 to provide an even surface. Because of the primer 300 or laminate 400 covering the front surface 106, it is not necessary to use plaster on the remainder of the front surface 106, and the difficulties of plastering within the tight angles formed by inner corners are avoided. The surface of the wall is then painted or otherwise finished as desired.

Figure 10:
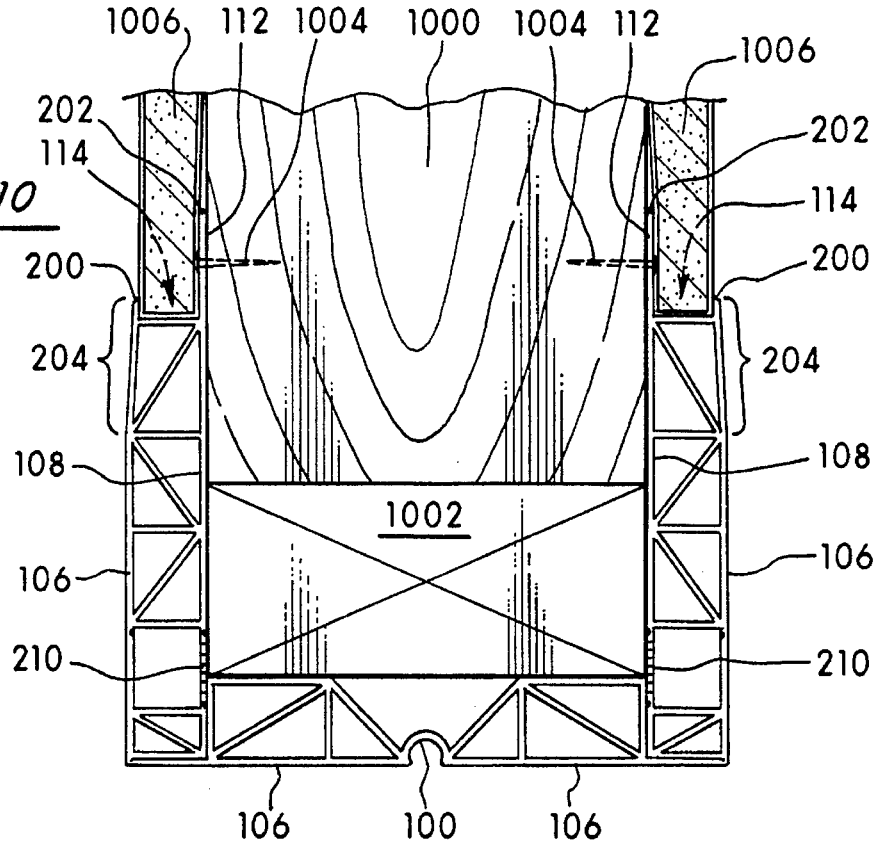
FIG. 10 shows a cross-sectional view of the drywall corner finishing device in accordance with the present invention applied around two outside corners.
Figure 11:
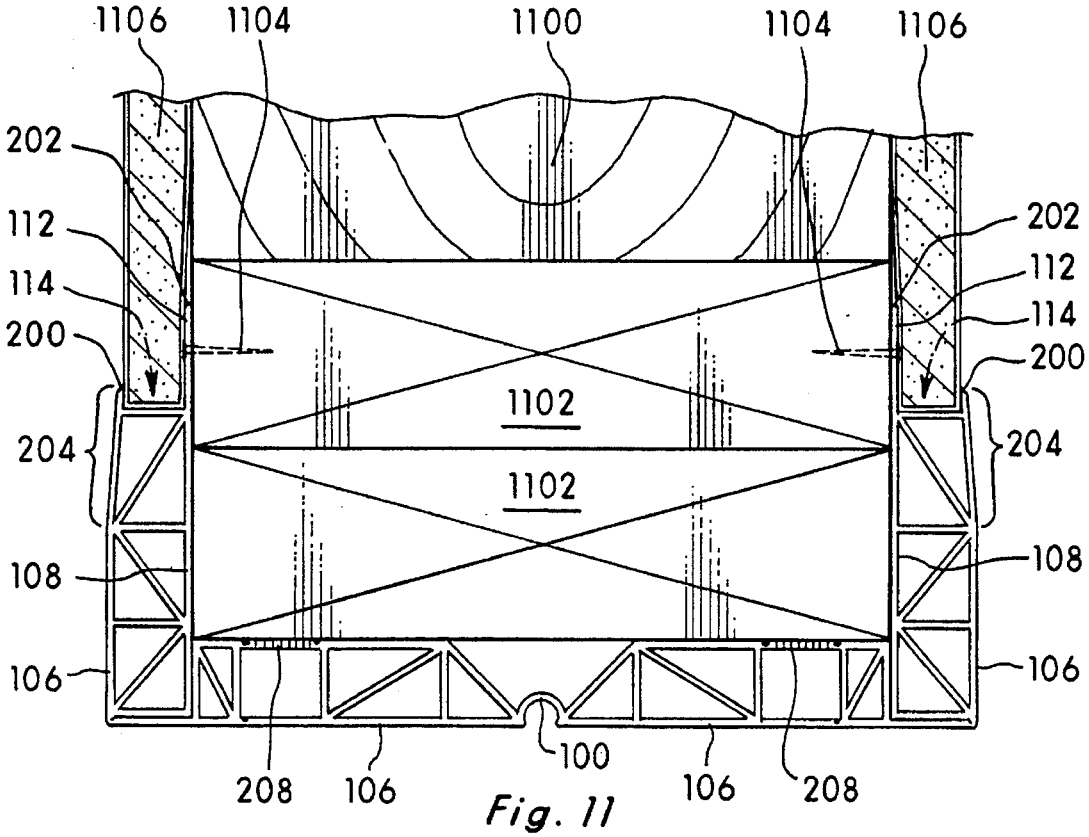
FIG. 11 is a cross-sectional view of the drywall corner finishing device in accordance with the present invention applied around two outside corners separated by a greater distance than the outside corners shown in FIG. 10.

Often outside corners exist next to each other. Two examples of such outside corners are shown in FIGS. 10 and 11. FIG. 10 illustrates outside corners formed by 2-by-4 framing boards 1000, 1002, and FIG. 11 shows outside corners formed by 2-by-6 framing boards 1100, 1102. The rear surface 108 contains at least two sets of removable strips 208, 210. It is to be expressly understood that the removable strips 208, 210 can be located in any convenient place on the rear surface 108 and that the present invention is not limited to the locations of the strips 208, 210 shown. Strips 208 are removed when 2-by-4 boards 1000, 1002 are used, and strips 210 are removed when 2-by-6 boards 1100, 1102 are used. Once the strips 208 or 210 are removed, the front surface 106 can be bent around both outside corners. This process is described below and shown in FIGS. 12(*a*)–12(*c*).

A removable strip 208 is held by a number of thin tags 1200 between the struts 206 parallel to the rear surface 108. To remove a strip 208, one need only break the thin tags 1200. The strip 208 is then removed in the direction of the arrow 1202 and discarded. The front surface 106 is then bent in the direction of the arrow 1204 to form a corner that will fit around one of the adjacent outside corners. It is to be understood that a similar but mirror-image process occurs with the second strip 208, so that the front surface 106 can be bent to form a second corner that will fit around the second of the juxtaposed outside corners. The strips 210 are removed in the same manner to permit the finishing device to be bent around two outside corners that are further apart.

Once the strips 208 or 210 are removed and the front surface 106 is bent, the finishing device is attached to the framing board 1000 or 1102 by use of nails 1004 or 1104. The attachment location of the device and the positions of the nails 1004, 1104 can be varied to enable the device to correct inaccuracies that may result from warped or mis-sized framing boards 1000, 1002, 1100, 1102 or inconsistencies in building practices. If necessary, shims may be placed behind the device before it is attached by nails 1004, 1104. The drywall panels 1006, 1106 are inserted as described above for inside corners, and the joint between the finishing device and the drywall panels 1006, 1106 is finished in the same manner as described above and shown in FIG. 13 for inside corners.

Figure 14:
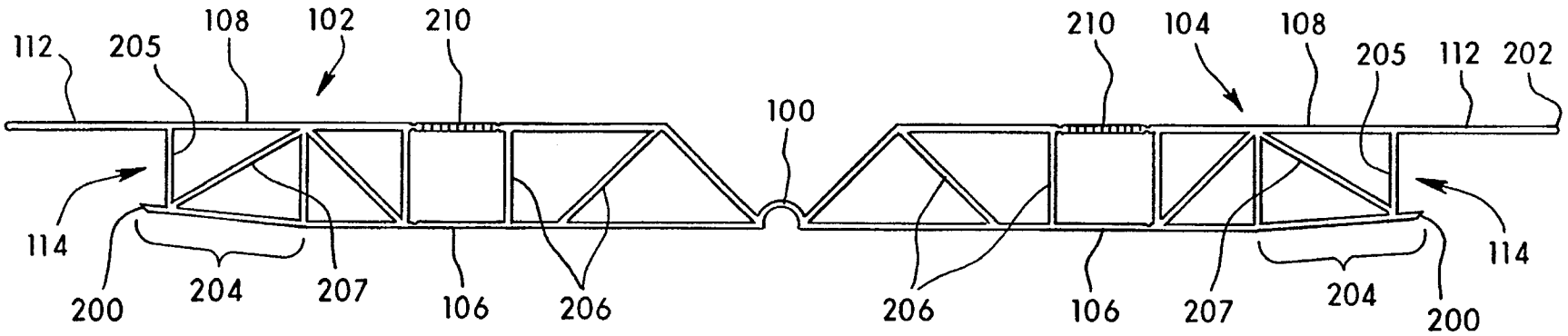
FIG. 14 is a cross-sectional view of an alternative embodiment of the drywall corner finishing device.

FIG. 14 shows a cross-sectional view of an alternative embodiment of the present invention. This embodiment provides only one set of removable strips 210 located equidistant from the center joint 100. The number and complexity of the struts 206 has also been reduced to simplify manufacture of the device by plastic extrusion. The arrangement of the distal struts 207 has also been changed for greater support to the tapered end 204 of the front surface of the device. If a portion of the rear flange 112 is drawn rearward to accommodate an uneven section in a rafter, the distal strut 207 will tend to allow the tapered front surface 204 of the device to maintain a straight edge in spite of irregularities in the underlying rafters. Assuming the device is molded from some type of flexible plastic, the end strut 205 will deform as necessary to accommodate such irregularies.

The above disclosure sets forth a number of embodiments of the present invention. Other arrangements or embodiments, not precisely set forth, could be practiced under the teachings of the present invention and as set forth in the following claims.

We claim:

1. A finishing device primarily for use in forming a corner between two panels of drywall have edges of a predetermined thickness, said finishing device comprising:

a flexible joint extending along a predetermined axis; and two wings connected to and extending outwardly in a diverging relation from said joint to form a corner having an adjustable angle, each wing having a front surface and an edge distal from said joint to abut one of said drywall panels, wherein said distal edge has a thickness approximately equal to said drywall panel edge thickness.

2. The finishing device of claim 1 further comprising a layer applied to said front surface of said wings for allowing paint to bond to said front surface.

3. The finishing device of claim 2 wherein said layer comprises primer.

4. The finishing device of claim 2 wherein said layer comprises an adhesive laminate.

5. The finishing device of claim 1 wherein said flexible joint has a substantially arcuate cross section.

6. The finishing device of claim 1 wherein said wing comprises a front surface and a rear surface spaced apart in a substantially parallel relationship with a plurality of struts extending between said front surface and said rear surface.

7. The finishing device of claim 6 wherein said front surface extends outwardly beyond said distal edge to cover said drywall panel edge.

8. The finishing device of claim 6 wherein said rear surface extends outwardly beyond said distal edge to provide a flange for attaching said finishing device to framing.

9. The finishing device of claim 6 wherein said rear surface further comprises a strip extending substantially parallel to said flexible joint that can be removed to allow a corresponding portion of said front surface to bend to form a second corner at a predetermined distance from said flexible joint.

10. A drywall corner finishing device comprising:

a flexible joint extending along the center longitudinal axis of said finishing device;

two wings connected to and extending outwardly in diverging relation from said flexible joint, said wings having a front surface and a rear surface, said front and rear surfaces being spaced apart in largely parallel relationship, said finishing device also having an edge distal from and parallel to said joint, wherein said distal edge has a thickness approximately equal to said drywall panel thickness; and at least two strips within said rear surface substantially parallel to and at a predetermined distance from said flexible joint that can be removed to allow said front surface to be folded around at least two outside corners at a predetermined distance from said flexible joint.

11. The drywall corner finishing device of claim 10 wherein a plurality of struts extend between said front surface and said rear surface.

12. The drywall corner finishing device of claim 10 wherein said device is made of plastic.

13. The drywall corner finishing device of claim 10 wherein said front surface extends outwardly beyond said distal edge to cover said edge of said drywall panels.

14. The drywall corner finishing device of claim 10 wherein said rear surface extends outwardly beyond said distal edge to provide a flange for attaching said finishing device to framing.

15. The drywall corner finishing device of claim 10 wherein said front surface tapers toward said rear surface.

16. The drywall corner finishing device of claim 10 wherein said device can be folded to a plurality of angles at said flexible joint so as to fit inside corners having a plurality of angles.

17. The drywall corner finishing device of claim 10 wherein said front surface is covered by a laminate.

18. The drywall corner finishing device of claim 10 wherein said front surface is covered with primer.

19. A drywall corner finishing device for use in forming a corner between two drywall panels having edges of a predetermined thickness, said device comprising:

an arcuate joint extending along the center longitudinal axis of said finishing device that allows said device to be folded to a plurality of angles at said joint;

two wings connected to and extending outwardly in diverging relation from said arcuate joint, said wings having a distal edge parallel to said center axis, said wings having a front surface and a rear surface, said front and rear surfaces being spaced apart in largely parallel relationship, said front and rear surfaces extending outwardly beyond said distal edge of said device and having a space therebetween, said space having a size equal to said thickness of said edge of said drywall panels; and a plurality of struts interposed between said front surface and said rear surface.

20. The drywall corner finishing device of claim 19 wherein said rear surface has within it at least two strips substantially parallel to and at a predetermined distance from said arcuate joint that can be removed to allow said device to bend around two juxtaposed outside corners.

21. The drywall corner finishing device of claim 19 wherein said front surface tapers toward said rear surface.

22. The drywall corner finishing device of claim 19 wherein said front surface is covered by a laminate.

23. The drywall corner finishing device of claim 19 wherein said front surface is covered with primer.

* * * * *

UNITED STATES PATENT AND TRADEMARK OFFICE

CERTIFICATE OF CORRECTION

PATENT NO. : 5,459,969

DATED : October 24, 1995

INVENTOR(S) : Paul E. Stibolt,
Russell E. Judy

It is certified that error appears in the above-indentified patent and that said Letters Patent is hereby corrected as shown below:

On the Title page, item [73], delete "Assignee: Kimberly Clark Corporation, Neenah, Wis."

Signed and Sealed this

Twentieth Day of February, 1996

*Attest:*

Bruce Lehman

BRUCE LEHMAN

*Attesting Officer*

*Commissioner of Patents and Trademarks*